United States Patent [19]

Yelderman

[11] Patent Number: 4,827,865

[45] Date of Patent: May 9, 1989

[54] PIVOTALLY COLLAPSIBLE BOAT

[76] Inventor: Joe C. Yelderman, Box 303, Needville, Tex. 77461

[21] Appl. No.: 211,036

[22] Filed: Jun. 24, 1988

[51] Int. Cl.[4] ..... B63B 7/02

[52] U.S. Cl. ..... 114/353; 114/356

[58] Field of Search ..... 114/352, 353, 356; 224/42.01, 42.03 R

[56] References Cited

U.S. PATENT DOCUMENTS

| | | | |
|---|---|---|---|
| 2,518,091 | 8/1950 | Stopkevyc | 114/352 |
| 2,659,464 | 3/1949 | Sweetman | 114/353 |
| 3,072,928 | 1/1963 | Hill | 114/352 |
| 3,090,053 | 5/1963 | Fletcher | 114/352 |
| 3,090,973 | 11/1959 | Levinson | 114/353 |
| 3,684,139 | 8/1972 | Johnson | 114/353 |
| 4,366,769 | 1/1983 | Lingeman | 114/352 |
| 4,478,167 | 10/1984 | Hart | 114/353 |
| 4,671,202 | 6/1987 | Johnson | 114/352 |

FOREIGN PATENT DOCUMENTS

| | | | |
|---|---|---|---|
| 30181 | 10/1931 | Australia | 114/353 |

*Primary Examiner*—Joseph F. Peters, Jr.
*Assistant Examiner*—Edwin L. Swinehart
*Attorney, Agent, or Firm*—Hubbard, Thurman, Turner & Tucker

[57] ABSTRACT

A boat construction comprising separate forward and rear sections. A rear wall of the forward section is pivotally connected to the forward wall of the rear section at a location adjacent the top end of such walls. An extension of the side walls of one of the boat sections snugly engages the adjacent side walls of the other boat section when they are pivoted to form a boat configuration. The two sections are pivoted to overlie each other for insertion of the boat inside of a station wagon-like car or in the back of a truck. The forward and rear sections are rigidly interconnected and significantly braced against the forces of wave action by the provision of transversely aligned apertures in the longitudinally extending flanges and the side walls of the boat section engaged by the longitudinally extending flanges. A transverse tube has its ends sealably secured in the side wall apertures to prevent entry of water into the particular boat section and a rigid rod traverses the apertures in the longitudinally extending flanges and the bore of the side wall to provide a rigid interconnection of the forward and rear sections in their boat configuration.

6 Claims, 1 Drawing Sheet

PIVOTALLY COLLAPSIBLE BOAT

BACKGROUND OF THE INVENTION

1. Field of the Invention

The invention relates to a collapsible boat comprising pivotally interconnected forward and rear sections which can be alternatively pivoted to overlie each other for transport within a vehicle, or pivoted into longitudinal alignment to form a boat configuration.

2. Summary of the Prior Art

A significant number of patents have heretofore been issued on the general concept of forming a combination boat and luggage carrier by pivotally interconnecting a forward section of a boat to a rearward section. When the forward and rear sections are pivoted to their longitudinally aligned configuration, they define a boat. The front section has an upwardly sloped bottom wall while the rear section of the boat carries a relatively heavy rear wall or transom suitable for the mounting of an outboard motor.

Patents illustrating such pivotally interconnected boat sections comprise the following: #2,659,464 to SWEETMAN #3,090,973 to LEVINSON, #3,684,139 to JOHNSON, #4,366,769 to LINGEMAN, #4,671,202 to JOHNSON and #4,478,167 to HART.

All of the aforementioned prior art constructions of pivotally collapible boats have the disadvantage of not effecting a sufficiently rigid securement of the forward and rear boat sections when longitudinally aligned to form the boat configuration to adequately resist the forces imparted to the boat by wave action. The prior art fastening devices have embodied latches, bolts which sealably traverse the rear wall of the forward section and the front wall of the rear section and, in several cases, interconnecting hinge elements secured to the side walls of the front and rear sections which are interengaged by a pivot pin when aligned in the boat configuration. All of these arrangements suffer from the disadvantages that the fastening means generally employ bolts or rivets to secure same to either the side walls or front and rear walls of the boat section and such bolts or rivets gradually work loose and fail under the repeated stresses produced by wave action on the boat.

SUMMARY OF THE INVENTION

A foldable boat embodying this invention comprises a generally rectangular forward section having a generally vertical rear wall, side walls, and a bottom wall which is upwardly curved at its forward end. The rear section of the boat is also of generally rectangular configuration and comprises upstanding front wall, side walls and a rear wall which is reinforced to provide a transom for mounting of an outboard motor. Suitable seats may be provided in the interior of the two sections.

The rear wall of the forward section and the forward wall of the rear section are abutting when in the boat configuration and both walls are provided with cooperating hinge elements to effect the pivotal securement of these two sections together along an axis positioned above the top surfaces of such walls. Thus the front sectiion may be selectively pivoted from an overlying position relative to the rear section to a longitudinally aligned position wherein the forward wall of the rear section and the rear wall of the forward section are in abutment. In the first mentioned configuration, the boat sections define a boat for transport within a vehicle. In the second position, the two sections define a boat configuration.

In order to rigidly interconnect the two sections in the boat configuration and provide adequate resistance to the repeated impact forces produced on the two sections by wave action, the side walls of the rear section are provided with longitudinally extending flanges which snugly encompass the forward ends of the side walls of the rear section when the forward section is folded into its boat configuration. Such side flanges provide a substantial degree of longitudinal rigidity but this is further reinforced by novel apparatus provided for effecting the detachable securement of the boat sections in their longitudinally aligned positions.

Aligned apertures are provided in the side flanges and the lower forward ends of the side walls overlapped by the side flanges. A rigid tube extending transversely across the rear boat section has its ends rigidly and sealably secured in the side wall apertures. A rigid rod is then inserted throggh the flange apertures and the bore of the tube and detachably secured therein.

With this arrangement, the forces exerted on the boat by wave action are resisted by the transversely extending tube and the inserted rigid rod. Since the transversely extending tube may be welded at its ends into the side wall apertures, there is a minimumal possibility that the mounting of such transverse tube will ever be loosened or destroyed by the forces of wave action on the boat.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 3:
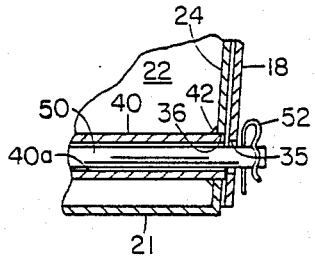
FIG. 3 is a partial sectional view illustrating the insertion and fastening of the reinforcing and securing rod to effect the securement of the boat sections in the position shown in FIG. 1.

Referring to the drawings, a pivotally collapsible boat 1 embodying this invention comprises a forward section 10 and a rear section 20. Each section is of generally rectangular configuration. The forward section 10 has a bottom wall 11 which is upwardly sloped at its forward end and integrally connected, upstanding side walls 12 and 13 and an upstanding rear wall 14 (FIG. 3). The walls are preferably welded to each other and to the bottom wall 11 to provide a water tight enclosure. A seat 15 may be secured across the forward end of the side aalls 12 and 13 and another seat, 16, which may comprise a totally enclosed compartment filled with foam plastic to provide adequate flotation for the boat, may be secured adjacent the rear wall 14.

The rear boat section 20 has a rectangular bottom wall 21 to which are integrally secured an upstanding forward wall 22, side walls 23 and 24 and a rear wall or transom 25 which is sufficiently rigid so as to be usable as a support for an outboard motor. These walls are welded or otherwise rigidly secured together to define a water tight compartment and, if desired, a seat 26 may be provided adjacent the rear wall 25 which, similar to the seat 16 may constitute a foam filled enclosure to provide additional flotation.

The top edges of the rear wall 14 of the forward section 10 and the forward wall 22 of the rear section 20 are provided with cooperating hinge elements 30. A tranverse hinge rod (not shown) permanently secures the cooperating hinge elements together. Thus the boat sections 10 and 20 may be pivotally folded from the aligned boat configuration shown in FIG. 1 to the overlying configuration shown in FIG. 2 wherein the boat sections 10 and 20 define a boat in storage position and suitable for transport within or on a vehicle.

In accordance with this invention, a pair of rearwardly projecting flanges 17 and 18 are welded to the rear ends of the side walls 12 and 13 of the forward boat section 10. Flanges 17 and 18 are configured to snugly engage the adjacent portions of the side walls 23 and 24 of the rear boat section 20, thus imparting a substantial degree of longitudinal rigidity to the two sections when aligned in the boat configuration of FIG. 1.

Figure 1:
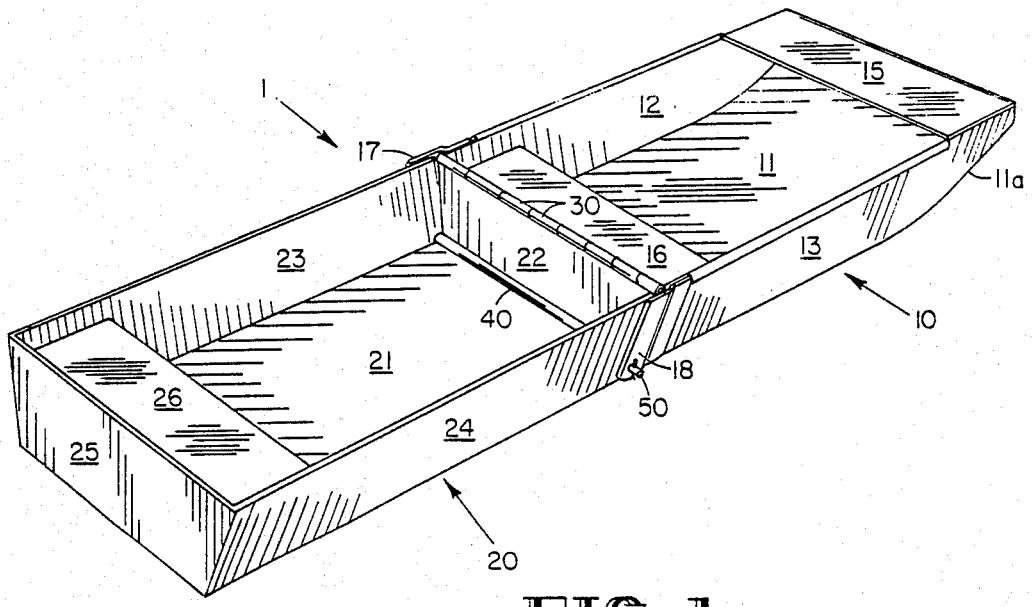
FIG. 1. is a perspective view of a pivotally collapsible boat embodying this invention with the boat shown in its non-collapsed position.
Figure 2:
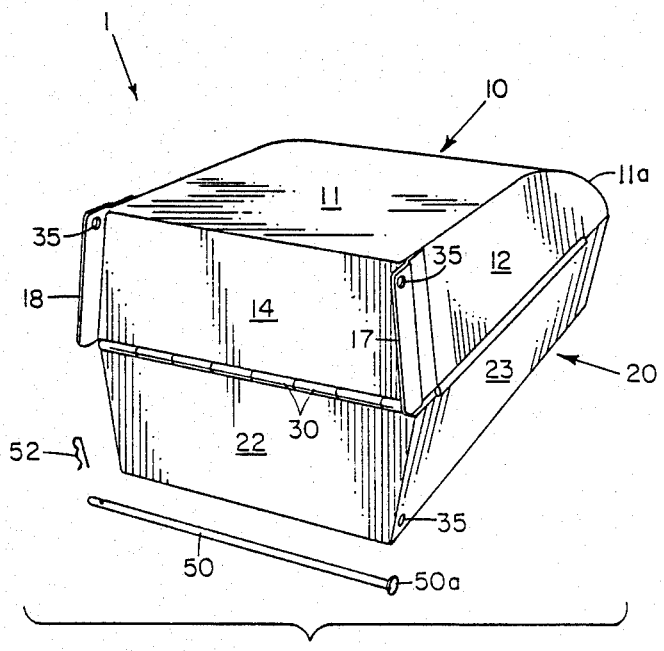
FIG. 2 is a perspective view showing the boat of FIG. 1 in its collasped position.

To effectively secure the two boat sections 10 and 20 in the boat configuration of FIG. 1 without the employment of screws, rivets and the like, a plurality of transversely aligned apertures 35 (FIGS. 2 and 3) are provided in the bottom rear portions of the flanges 17 and 18 and the corresponding positions of the forward end of the side walls 23 and 24 of the rear section 20. A support tube 40 is then inserted in transverse relationship to the rear boat section 20, preferably adjacent the forward bottom corner of the rear boat section 20, and has it ends respectively rigidly and sealably secured in the apertures 35 provided in the side walls 23 and 24. Such securement is preferably effected by a circumferential weld 42.

The securement of the boat sections 10 and 20 in their longitudinally aligned positions is then effected by a transverse rigid rod 50 which traverses the bore 40*a* of the securing tube and has an enlarged head 50*a* on one end thereof and is secured in position by a lynch pin 52 which is inserted through a suitable diametrical hole provided in the other end of the rigid rod 50.

From the foregoing description, it will be readily apparent that the forward and rear boat sections are not only securely fastened in their longitudinally aligned boat configuration but such fastening is effected by means which are not secured to the boat sections by bolts or rivets which, when the boat sections are subjected to the pounding action of waves are prone to loosen and fail. The welded mounting of the supporting tube 40 in the rear section 20 provides adequate assurance that this type of failure will be avoided.

Those skilled in the art will recognize that the flanges 17 and 18 could be provieed on the forward ends of the walls 23 and 24 of the rear boat section 20 and the support rod 40 mounted in the rear bottom portion of the forward boat section 10. The location of the flanges 17 and 18 and the supporting tube 40 in either the forward or rear boat section is merely a matter of design choice.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A structure adapted to be selectively converted into a boat from a vehicular transport mode suitable for carriage within or on a vehicle, comprising:

a rear section comprising a substantially flat rectangular bottom wall and upstanding front, rear, and side walls defining a closed water tight periphery;

a forward section comprising a generally rectangular bottom wall having an upwardly curved forward end, and upstanding rear and side walls, said curved forward end, rear and side walls defining a closed water tight periphery;

hinge means disposed along the top of said rear section front wall and the top of said forward section rear wall for pivotally interconnecting said front and rear walls, whereby said forward section may be selectively pivoted into substantially longitudinal alignment with said rear section to form a boat, or pivoted over said rear section to form an enclosure adapted to be opened from one end thereof;

said rear section front wall and said forward section rear wall being disposed in abutting relation when pivoted to form a boat;

a pair of longitudinally projecting flanges on the vertical edges of said forward section rear wall snugly engaging the side edges of said rear section abutting wall to provide longitudinal rigidity to said forward and rear sections when disposed in said boat configuration; and means traversing said flanges and said rear section for detachably securing said forward and rear sections in said boat configuration.

2. The apparatus of claim 1 wherein said means for detachably securing said forward and rear sections in said boat configuration comprises a tube traversing the bottom wall of said rear section and having the ends of said tube sealed in said side walls of said rear section to prevent entry of water into said rear section; and a rigid rod traversing said flanges and the bore of said tube.

3. The apparatus of claim 2 further comprising means for detachably securing said rod in said position traversing said flanges and the bore of said tube.

4. A structure adapted to be selectively converted into a boat from a vehicular transport mode for carriage within or on a vehicle comprising:

a rear section comprising a substantially flat rectangular bottom wall and upstanding front, rear, and side walls defining a closed water tight periphery;

a forward section comprising a generally rectangular bottom wall having an upwardly curved forward end, and upstanding rear and side walls, said curved forward end, rear and side walls defining a closed water tight periphery;

hinge means disposed along the top of said rear section front wall and the top of said forward section rear wall for pivotally interconnecting said front and rear walls, whereby said forward section may be selectively pivoted into substantially longitudinal alignment with said rear section to form a boat, or pivoted over said rear section to form an enclosure adapted to be opened from one end thereof, said rear section front wall and said section rear wall being disposed in abutting relation when pivoted to form a boat; and a pair of longitudinally projecting flanges on the sides of one of said sections, said longitudinally projecting flanges being constructed and arranged to snugly engage the side walls of the other section when said sections are pivoted to form a boat; and means traversing said flanges and the entire width of said other section for detachably securing said forward and rear sections in said boat configuration.

5. The apparatus of claim 4 wherein said means for detachably securing said forward and rear sections in said boat configuration comprises:

aligned transverse apertures in said flanges and said side walls of said other section;

a tube traversing said other section and having its ends respectively sealably secured in said side wall apertures; and a rigid rod traversing said flange apertures and the bore of said tube.

6. The apparatus of claim 5 further comprising means for detachably securing said rod in said position traversing said flanges and the bore of said tube.

* * * * *